US005249893A

United States Patent [19]

Romanek et al.

[11] Patent Number: 5,249,893

[45] Date of Patent: Oct. 5, 1993

[54] EROSION CONTROL MAT

[75] Inventors: Gerald A. Romanek; Roger E. Moon, both of Greenville; Mark L. Marienfield, Greer; Sukhdev S. Guram, Greenville, all of S.C.

[73] Assignee: Phillips Petroleum Company, Bartlesville, Okla.

[21] Appl. No.: 338,784

[22] Filed: Apr. 13, 1989

[51] Int. Cl.[5] ..... E02D 3/12

[52] U.S. Cl. ..... 405/258; 405/19; 405/15

[58] Field of Search ..... 405/15, 16, 19, 258; 47/9, 56

[56] References Cited

U.S. PATENT DOCUMENTS

| | | | |
|---|---|---|---|
| 3,557,491 | 1/1971 | Franklin et al. | 47/56 |
| 3,888,041 | 6/1975 | Seith et al. | 47/9 |
| 3,928,696 | 12/1975 | Wandel et al. | 405/19 X |
| 3,935,046 | 1/1976 | Kiernan et al. | 156/148 |
| 4,181,450 | 1/1980 | Rosen et al. | 405/19 |
| 4,252,590 | 2/1981 | Rosen et al. | 156/167 |
| 4,283,880 | 8/1981 | Fjeldsa | 47/9 X |
| 4,329,392 | 5/1982 | Bronner | 405/19 X |
| 4,342,807 | 8/1982 | Rosen et al. | 428/180 |
| 4,353,946 | 10/1982 | Bowers | 405/19 X |
| 4,377,919 | 3/1983 | Gams | 47/9 X |
| 4,519,161 | 5/1985 | Gilead et al. | 47/9 |

*Primary Examiner*—Dennis L. Taylor

*Attorney, Agent, or Firm*—David L. Kinsinger

[57] ABSTRACT

A process and fabric for controlling soil erosion which comprises an erosion control mat formed of a scrim having a lightweight web secured thereto to be utilized by applying the erosion control mat to a soil surface. A method of producing such erosion control mat is also disclosed.

17 Claims, 1 Drawing Sheet

EROSION CONTROL MAT

FIELD OF THE INVENTION

This invention relates to a process for controlling soil erosion utilizing an erosion control mat, a fabric comprising said erosion control mat, and a process for making said erosion control mat.

BACKGROUND OF THE INVENTION

In soil erosion control, it is desirable to control erosion permanently by replanting the exposed soil area which is eroding. However, until the soil is stabilized, replanting is impractical, due to the continued erosion of the soil as well as the soil's unsuitability for replanting without being reworked to facilitate plant germination and growth. One method of controlling soil erosion to enable replanting is by utilizing erosion control mats.

The soil erosion control mats previously available were designed to control soil erosion by retaining the soil in a fabric nap. But, to be effective in retaining the soil in the nap of the fabric, the mats had to have either a dense weave or be made of a heavy weight fabric. These erosion control mats have several drawbacks for erosion control. First, these mats tend to be expensive because of the amount of material used to provide the densely woven mat. Second, these mats also tend to be difficult to replant through because of their density and weight. Third, some of these mats also tend to be lifted by plants growing underneath the mat, resulting in inhibited plant growth and new sites for erosion being created. Fourth, most of the erosion control mats previously available did not hold seeds in place or retain moisture for seed germination. And finally, most of the erosion control mats previously available tend to be difficult to install, expensive to purchase, and less than effective in erosion control.

Thus, it would be a significant contribution to the art to develop an erosion control mat which demonstrates improved soil erosion control. Additionally, it would also be advantageous if an erosion control mat were developed which allowed for easy planting. Further, it would be advantageous if an erosion control mat were developed which allowed for improved growth of plants through the erosion control mat without inhibiting plant growth or generating new sites for erosion to develop. Moreover, it would be advantageous if an erosion control mat were developed which is inexpensive to produce, purchase, and install while being effective in erosion control.

It is thus an object of this invention to provide an erosion control mat which demonstrates improved soil erosion control.

It is a further object of this invention to provide an erosion control mat which allows for easy replanting through the erosion control mat.

It is also an object of this invention to provide an erosion control mat which facilitates the replanting of the exposed soil area by securing seeds in place as well as retaining moisture for seed germination.

It is still a further object of this invention to provide an erosion control mat which allows for regrowth of plants through said erosion control mat without inhibiting plant growth or generating new sites for erosion to develop.

It is still another object of this invention to provide an erosion control mat which is economical to produce, inexpensive to purchase and install, and effective in erosion control.

Other aspects, objects, and several advantages of this invention will be apparent from the specification, examples, and claims.

SUMMARY OF THE INVENTION

In accordance with the present invention, we have discovered a process for controlling soil erosion which comprises providing an erosion control mat formed of a scrim having a lightweight web secured thereto and applying said erosion control mat to a soil surface.

In accordance with another aspect of the present invention, we have also discovered a composite fabric comprising a scrim having a uniform lightweight web secured thereto forming said erosion control mat, and a process for making said erosion control mat.

DETAILED DESCRIPTION OF THE INVENTION

Figure 1:
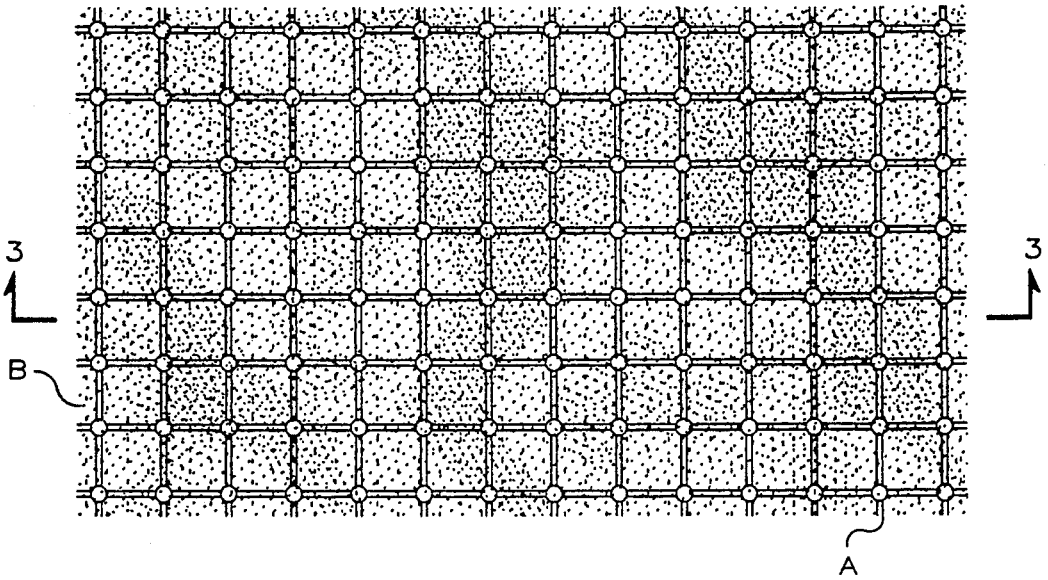
FIG. 1 provides a top view of the erosion control mat showing the scrim designated as A and the light weight web designated as B.
Figure 2:
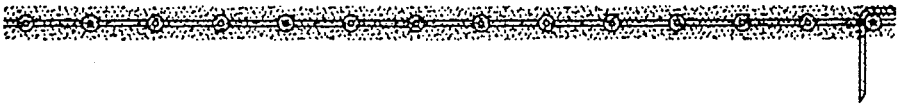
FIG. 2 provides a side view of the erosion control mat.
Figure 3:
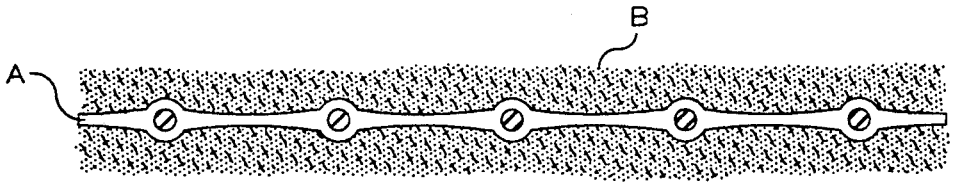
FIG. 3 provides an enlarged side view of the erosion control mat with the scrim shown from a side on view and designated as A and the light weight web shown by the cross hatching and designated as B.

The erosion control mat of the present invention is a composite fabric composed of a scrim having a uniform lightweight web secured thereto. Scrim suitable for use in the present invention may be made from a variety of materials, including, but not limited to, materials selected from the group consisting of polypropylene, polyester, nylon, rayon, polyethylene, cotton, and combinations of any two or more thereof. It is desirable that the scrim form an open grid or net like structure having suitable strength to reinforce the lightweight web secured thereto. For this purpose, it is recommended that the scrim have a weight in the range of from about $3\frac{1}{2}$ pounds per thousand square feet (about $\frac{1}{2}$ ounce per square yard) to about 1 pound per thousand square feet (about 1/7 ounce per square yard). It is preferred that the scrim have a weight of from about 2.9 pounds per thousand square feet (about 2/5 ounce per square yard) to about $1\frac{1}{2}$ pounds per thousand square feet (about 1/5 ounce per square yard). It is most preferred that the scrim have an average weight of about 2.9 pounds per thousand square feet (about 2/5 ounce per square yard). The grid size of the scrim should be selected to provide a uniform reinforcing and be large enough to allow for easy plant penetration through the grid. The grid opening size of the scrim can range generally from about 1 inch to about 1/16 inch. The preferred grid size for the practice of the present invention with a needle-punched web is about $\frac{3}{4}$ inch to about $\frac{5}{8}$ inch. There is no requirement that these grids be of a uniform rectangular shape; other grid shapes may be utilized. The method of manufacturing scrims is known in the art and any suitable method which would result in a scrim as described above may be employed for the practice of the present invention.

The lightweight web utilized in the practice of the present invention may be made from a variety of materials, including, but not limited to, materials selected from the group consisting of polypropylene, polyester, nylon, rayon, polyethylene, cotton, and combinations of any two or more thereof. It is currently preferred that polypropylene or rayon or combinations thereof be used to form said lightweight web due to their excellent adherence to soil, which makes them particularly well suited to the present invention. For the practice of the present invention, a lightweight web is defined to be of a semi-uniform nature having a weight in the range of from about 2½ ounces per square yard to ¼ ounces per square yard. Preferably, said lightweight web will have a weight in the range of from about 1½ ounces per square yard to about ½ ounces per square yard. The denier of the fibers or filaments used to make a suitable lightweight web will generally be in the range of from about 60 to about 1, preferably, the denier of the fibers or filaments will range from about 18 to about 1½. Most preferably, the denier of the fibers or filaments used to make said lightweight web will range from about 4½ to about 1½. The lightweight web is preferably made up of unconsolidated fibers which means the fibers are not secured to one another by means including, but not limited to, fusion, glue, or needle-punching. Methods of making a suitable lightweight web are known to those skilled in the art. One suitable method for the practice of the present invention of making a suitable lightweight web is by carding the staple fibers. Preferably, the length of said staple fibers used for carding will be in the range from about 7 inches to about ¾ inch. More preferably, staple fibers in the range of from about 5 inches to about 2 inches will be used to form said lightweight web.

The scrim and the lightweight web may be assembled and bonded together by any suitable technique known to those skilled in the art, including, but not limited to, chemical, thermal, or mechanical (including sonic and needle-punch techniques) bonding methods wherein the composite fabric which will be used as an erosion control mat formed thereby still allows for the ready pentration of plants, light, and water through the erosion control mat. It is presently preferred that the carded staple fiber, which forms the lightweight web, be placed in line with the scrim and that no crosslapping be performed when the lightweight web is combined with the scrim. It is also presently preferred to bond the scrim to the lightweight web by needle-punching the lightweight web to the scrim. Needle-punching may be performed by utilizing any suitable needle-punching techniques or machinery such as a needle-punch loom. Any suitable needle-punch density may be used which results in the attachment of the lightweight web to the scrim. A presently preferred range of needle-punch densities is in the range of from about 25 to about 200 punches per square inch. The composite fabric formed by needle-punching the lightweight web to the scrim can optionally be trimmed and rolled for ease of handling. Optionally, after the composite fabric is formed, it may be further treated by compression rolling for fabric compaction. Additionally, the final composite fabric formed or the scrim and/or lightweight web could be colored for esthetic purposes.

Stabilizers may also be incorporated into the materials making up the scrim or the lightweight web, to tailor the erosion control mat to the circumstances under which it will be utilized. It may be appropriate to add stabilizers such as UV stabilizers, bactericide, or other additives to the materials making up the scrim and the lightweight web when the erosion control mat must remain in situ for a long period of time. However, where replanting is performed and plant growth is anticipated to rapidly recover an area, stopping further erosion, it may be desirable to not have any stabilizers present in the materials making up the scrim or lightweight web thereby rendering the erosion control mat environmentally degradable. In some situations, it may be desirable to utilize stabilizers in the scrim but not the lightweight web or in the lightweight web but not the scrim. Suitable stabilizers are readily available and may be selected by those skilled in the art and may be utilized with the guidelines above in mind.

The composite fabric so formed may be utilized by applying said composite fabric as an erosion control mat to an exposed area where erosion is desired to be controlled. The erosion control mat of the present invention is suitable for installation in a great variety of situations where the ground has been disturbed and the soil is subject to erosion including, but not limited to the replanting of highway and railroad embankments, construction sites, mining and mining reclamation sites, park areas, and landfills. To install the erosion control mat of the present invention it is recommended that the soil surface be smoothed to allow placement of the mat in contact with the soil surface. The soil surface can be smoothed with readily available equipment including, but not limited to, graders, tractors with box blades, or other suitable implements. It is most preferred if the area is raked but this is by no means necessary.

The soil surface to be replanted can be seeded before or after applying the erosion control mat. Preferably the soil surface will be seeded immediately before placement of the erosion control mat with any suitable seeds such as grasses. If necessary or desirable, the soil surface can be fertilized or otherwise treated. The erosion control mat of the present invention will then be applied to the soil surface. Preferably, the erosion control mat will be applied in a manner which does not stretch or pull the mat taut. The erosion control mat should be secured to the soil surface about the perimeter by fastening means. The fastening means should be sufficient to secure the erosion control mat to the soil surface. Suitable fastening means include, but are not limited to, about 4 inch to about 6 inch U-shaped pins or straight pegs. If the area of soil surface to be covered is wider than the width of the erosion control mat, it is preferred that the adjacent mat edges be overlapped and the overlapped edges be secured by fastening means similar to those utilized on the perimeter. Additionally, it is preferred that the adjacent mat edges of the erosion control mats be overlapped by at least 3 inches.

Lightly watering the soil erosion control mat when in place is also preferred because water will interlock the lightweight web to the soil surface, thereby also holding seeds planted under the mat in place and further securing the soil erosion control mat. Seeds planted with the soil erosion control mat will grow through the mat because of its loose fibrous nature while at the same time the soil will be stabilized by the scrim and fiber combination, thereby controlling erosion.

The following nonlimiting examples are provided to further illustrates the practice of the present invention.

EXAMPLE I

Fabrication of the Erosion Control Mat

A reinforcing scrim was acquired from Maynard Plastics. This reinforcing scrim, Product No. 6395, was a polypropylene extruded netting scrim containing no UV stabilizers. It weighed approximately 2.9 pounds per thousand square feet, with a rectangular grid size of approximately ¾ inch by ⅝ inch. This scrim was overlaid with a lightweight nonwoven web made of 4.0 denier polypropylene staple fibers having a nominal staple length of 3¼ inches which had been carded. The scrim and the lightweight web were assembled in line. The scrim overlaid with the web was then fed into a needle loom where it was needle-punched with approximately 30–50 punches per square inch to form the erosion control mat. The erosion control mat was then trimmed to the desired width and wound up on a roll.

EXAMPLE II

Application of the Erosion Control Mat

The erosion control mat produced as described in Example I was installed on a highway embankment with greater than a 27° slope. The soil surface, which was free of vegetation, was smoothed and prepared for reseeding with grass. The soil surface was then reseeded by normal seeding means and fertilized. The erosion control mat was then installed over an area which had been seeded and treated with lime. The erosion control mat was installed by placing the mat on the soil surface and securing the perimeter with about 6 inch U-shaped pins and soil. The pins were driven through the perimeter into the soil surface and soil was placed upon the perimeter. No further treatment of the soil surface was performed. In 3 weeks the site was inspected and the area covered with the erosion control mat was visually compared to the untreated soil surface. The area covered with the erosion control mat showed thick, verdant growth. The untreated area (with no erosion control mat) showed only sparse tufts of grass present.

This example demonstrates that the erosion control mat of the present invention is effective in holding seeds in place and providing suitable conditions for plant growth as well as preventing erosion.

That which is claimed is:

1. A process for controlling erosion of a soil surface which comprises applying to said soil surface an erosion control mat formed of (a) a scrim having a grid sufficiently sized to provide (1) uniform reinforcing and (2) plant penetration through the grid and bonded to said scrim (b) a uniform, non-crosslapped, unconsolidated lightweight web weighing in the range of from about 2½ ounces per square yard to about ¼ ounce per square yard wherein the lightweight web will allow ready penetration of plants, light, and water thereby providing erosion control to said soil surface.

2. The process of claim 1 wherein the scrim weighs in the range from about 3½ pounds per thousand square feet to about 1 pound per thousand square feet wherein said scrim is characterized by an open grid structure having a grid size in the range from a maximum of about 1 inch to a minimum of about 1/16 inch.

3. The process of claim 1 wherein said scrim is made of a material selected from the group consisting of polypropylene, polyester, nylon, rayon, polyethylene, cotton, and combinations of any two or more thereof.

4. The process of claim 1 wherein the lightweight web is made of a material selected from the group consisting of polypropylene, polyester, nylon, rayon, polyethylene, cotton, and combinations of any two or more thereof.

5. The process of claim 1 wherein the lightweight web is made of carded staple fibers.

6. The process of claim 1 wherein said lightweight web is secured to said scrim by needle-punching.

7. The process of claim 1 wherein the scrim is characterized by an open grid structure having a grid opening size in the range of from about ¾ inch to about ⅝ inch.

8. The process of claim 1 wherein the erosion control mat is secured to a soil surface by fastening means.

9. The process of claim 8 wherein the fastening means is placed about the perimeter of the erosion control mat.

10. The process of claim 1 wherein the soil surface is seeded prior to applying the erosion control mat to the soil surface.

11. The process of claim 1 wherein after the erosion control mat is secured to the soil surface, the erosion control mat is watered.

12. A process for controlling soil surface erosion which comprises providing an erosion control mat formed of a scrim of polypropylene having a weight from about 2.9 pounds per thousand square feet to about 1 pound/thousand ft.$^2$ and an open grid structure having a grid size of from a maximum of about 1 inch to a minimum of about 1/16 inch having a uniform lightweight web of polypropylene staple fibers having a denier in the range of from about 60 to about 1 and staple length in the range of from about 7 inches to about ¾ inch and a weight from about 2½ ounces per square yard to about ¼ ounce per square yard secured to said scrim by needle-punching, and securing said erosion control mat so formed to a soil surface thereby providing erosion control to said soil surface.

13. The process of claim 12 wherein the erosion control mat is secured to a soil surface with fastening means.

14. The process of claim 13 wherein the fastening means is placed about the perimeter of the erosion control mat.

15. The process of claim 12 characterized further to include seeding the soil surface prior to securing the erosion control mat to a soil surface.

16. The process of claim 12 characterized further to include watering the erosion control mat after the erosion control mat is secured to a soil surface.

17. The process of claim 12 wherein the erosion control mat is environmentally degradable.

* * * * *